United States Patent [19]

Fromell et al.

[11] 4,308,178

[45] Dec. 29, 1981

[54] THERMIONIC CATHODE EMITTER COATING

[75] Inventors: Harry J. Fromell; Philip W. Ghaner, both of Altoona, Pa.

[73] Assignee: North American Philips Consumer Electronics Corp., New York, N.Y.

[21] Appl. No.: 75,851

[22] Filed: Sep. 17, 1979

[51] Int. Cl.[3] ..... H01B 1/00

[52] U.S. Cl. ..... 252/513; 252/519; 252/521; 313/346 R; 313/346 DC

[58] Field of Search ..... 252/513, 521, 519, 518; 313/346 R, 346 DC

[56] References Cited

U.S. PATENT DOCUMENTS

| | | | |
|---|---|---|---|
| 2,716,716 | 8/1955 | Hughes et al. | 313/346 DC |
| 2,848,644 | 8/1958 | Koppuis | 313/346 DC |
| 3,170,772 | 2/1965 | Sato et al. | 313/346 DC |
| 3,500,106 | 3/1970 | Beuhtold | 252/513 X |
| 3,879,830 | 4/1975 | Buescher | 313/346 DC X |
| 3,913,057 | 10/1975 | Ushida et al. | 252/520 |
| 3,962,145 | 6/1976 | Matsuo et al. | 252/519 |
| 4,081,713 | 3/1978 | Misumi | 252/521 |
| 4,101,800 | 7/1978 | Thomas et al. | 313/346 R |

*Primary Examiner*—J. L. Barr

*Attorney, Agent, or Firm*—John C. Fox

[57] ABSTRACT

Emission quantity of thermionic cathodes is increased by including in the potentially emissive material applied to a cathode substrate a quantity of a readily reducible metallic oxide. During cathode processing the metal oxide provides free oxygen gas which aids in binder removal.

1 Claim, No Drawings

THERMIONIC CATHODE EMITTER COATING

TECHNICAL FIELD

This invention relates to thermionic cathodes and more particularly to the emitter coating for such cathodes. Still more particularly, the invention pertains to such coatings containing an additive which enhances cathode processing and increases emission levels.

BACKGROUND ART

The employment of thermionic cathode coatings in electron discharge devices is well known. These coatings, as applied to cathode substrates of suitable materials, such as nickel or nickel alloys, generally comprise barium carbonate and one or more of the carbonates of calcium or strontium together with an organic binder to allow the coating to be painted, dipped, sprayed or otherwise applied to a particular area of the cathode substrate. Subsequent processing reduces the carbonates to the oxides and then to the free metals, particularly barium, (which supplies the electrons) and volatilizes and removes the organic binder, this processing being done while the device is on exhaust. While this procedure has been employed for many years it is difficult to always remove all of the binder material, and that which remains results in below normal emission properties for the device.

DISCLOSURE OF INVENTION

It is an object of this invention to enhance the operation of thermionic cathodes.

It is another object of this invention to obviate the disadvantages of the prior art.

These objects are accomplished in one aspect of the invention by the provision of a potentially emissive material for electron discharge devices which comprises at least barium carbonate and can include at least one carbonate selected from the group of calcium and strontium. Also included is an organic binder and a readily reducible metal oxide. During cathode processing, the metal oxide is reduced to the metal and the liberated oxygen therefrom greatly aids in the removal of the organic binder, thus providing higher emission levels and a cleaner anode surface.

BEST MODE FOR CARRYING OUT THE INVENTION

For a better understanding of the invention, together with other and further objects, advantages and capabilities thereof, reference is made to the following disclosure and appended claims.

A potentially electron emissive, thermionic cathode material for electron discharge devices comprises at least barium carbonate and can include at least one other carbonate selected from the group of calcium carbonate and strontium carbonate. As used herein the term "potentially emissive" refers to the cathode material as it is applied to a cathode substrate. Subsequent processing reduces the carbonates to the oxides and then to the metals, particularly barium, which, because of its low work function, is the primary electron source. These carbonates are mixed with an organic binder, a number of which are known. One such binder, available from E. I. Dupont de Nemours and Company under the trade name Pyroxylin No. 5511 comprises 12.2% nitrocellulose, 6.6% ethyl alcohol (dehydrated), 81.2% amyl acetate and a 12.2% total total content. Other binders comprise ethyl celloluse with various solvents such as ethylene carbonate, butyl carbitol, toluene, etc.

In accordance with the invention, to a suitable mixture of carbonates and binder there is added a quantity of a readily reducible metal oxide. As used herein the term "readily reducible" refers to a material which will give up its oxygen within the parameters necessary to prepare the electron discharge device within which it is being employed. The cation of the additive must be one which will not harm the emissive material. In one embodiment, the readily reducible oxide is nickelous oxide. In a preferred embodiment of the invention a cathode material having a given dry weight of carbonates includes, by weight of the carbonates from about 5% to about 20% of nickel powder, with about 10% to 25% of the nickel being in the form of nickelous oxide.

The potentially emissive material is prepared by adding the readily reducible oxide to the carbonate system and binder in a ball mill. Milling should take place for about one (1) hour after which the material is sifted through a suitable sieve, such as a 100 mesh sieve.

Application of the material to a cathode substrate can then be effectuated by any of the known techniques, such as spraying, dipping, painting, etc.

During tube processing, the reduction of the metal oxide releases quantites of oxygen gas which gas greatly enhances the removal of the organic binder. The more complete binder removal provides higher emission levels for the cathode, as well as keeping the other tube components, particularly the anode in damper tubes, cleaner.

While there have been shown and described what are at present considered to be the preferred embodiments of the invention, it will be apparent to those skilled in the art that various changes and modifications can be made herein without departing from the scope of the invention as defined by the appended claims.

We claim:

1. A potentially electron emissive material for electron discharge devices consisting essentially of: barium carbonate and at least one carbonate selected from the group of calcium and strontium; an organic binder; nickel powder; and nickelous oxide; said nickel powder being present in an amount of from about 5% to about 20% by weight of said carbonates; and said nickelous oxide being present in an amount of from about 10% to 25% by weight of said nickel, said nickelous oxide providing free oxygen during subsequent processing of said material.

* * * * *